US005618359A

United States Patent [19]

Lin et al.

[11] Patent Number: 5,618,359

[45] Date of Patent: Apr. 8, 1997

[54] METALLIC GLASS ALLOYS OF ZR, TI, CU AND NI

[75] Inventors: Xianghong Lin; Atakan Peker; William L. Johnson, all of Pasadena, Calif.

[73] Assignee: California Institute of Technology, Pasadena, Calif.

[21] Appl. No.: 569,276

[22] Filed: Dec. 8, 1995

Related U.S. Application Data

[63] Continuation-in-part of Ser. No. 385,279, Feb. 8, 1995, abandoned.

[51] Int. Cl.[6] ..... C22C 45/00

[52] U.S. Cl. ..... 148/561; 148/403; 148/421; 148/435; 420/423; 420/488; 420/587

[58] Field of Search ..... 148/403, 421, 148/432, 435, 561; 420/417, 423, 488, 492, 587

[56] References Cited

U.S. PATENT DOCUMENTS

| | | | |
|---|---|---|---|
| 4,113,478 | 9/1978 | Tanner et al. | 148/403 |
| 4,126,449 | 11/1978 | Tanner et al. | 148/403 |
| 4,135,924 | 1/1979 | Tanner et al. | 148/403 |
| 4,148,669 | 4/1979 | Tanner et al. | 148/561 |
| 5,288,344 | 2/1994 | Peker et al. | 420/417 |
| 5,380,375 | 1/1995 | Hashimoto et al. | 148/403 |

FOREIGN PATENT DOCUMENTS 6-264200 9/1994 Japan .

OTHER PUBLICATIONS

Massalski, et al., *Solidification Structures in Rapidly Quenched Cu–Ti–Zr Alloys,* Metallurgical Transactions A, vol. 19A, Jul. 1988, pp. 1853–1860.

Malokanov, et al., *Structure and Properties of Alloys of the Section* $Ti_2$ Ni–$Zr_2$Ni of Ti–Zr–Ni Systems in Amorphous and Crystalline States, 1989 Plenum Publishing Corporation, pp. 46–49.

Rabinkin, et al., *Amorphous Ti–Zr — Base Metglass® Brazing Filler Metals,* Scripta Metallurgica et Materialia vol. 25, 1991, pp. 399–404.

*Primary Examiner*—George Wyszomierski
*Attorney, Agent, or Firm*—Christie, Parker & Hale, LLP

[57] ABSTRACT

At least quaternary alloys form metallic glass upon cooling below the glass transition temperature at a rate less than $10^3$K/s. Such alloys comprise titanium from 19 to 41 atomic percent, an early transition metal (ETM) from 4 to 21 atomic percent and copper plus a late transition metal (LTM) from 49 to 64 atomic percent. The ETM comprises zirconium and/or hafnium. The LTM comprises cobalt and/or nickel. The composition is further constrained such that the product of the copper plus LTM times the atomic proportion of LTM relative to the copper is from 2 to 14. The atomic percentage of ETM is less than 10 when the atomic percentage of titanium is as high as 41, and may be as large as 21 when the atomic percentage of titanium is as low as 24. Furthermore, when the total of copper and LTM are low, the amount of LTM present must be further limited. Another group of glass forming alloys has the formula $$(ETM_{1-x}Ti_x)_a Cu_b (Ni_{1-y}Co_y)_c$$

wherein x is from 0.1 to 0.3, y•c is from 0 to 18, a is from 47 to 67, b is from 8 to 42, and c is from 4 to 37. This definition of the alloys has additional constraints on the range of copper content, b.

24 Claims, 2 Drawing Sheets

METALLIC GLASS ALLOYS OF ZR, TI, CU AND NI

This invention was made with Government support under DE-FG03-86ER45242 awarded by the Department of Energy. The Government has certain rights in the invention.

BACKGROUND

This application is a continuation in part to U.S. patent application Ser. No. 08/385,279, filed Feb. 8, 1995, now abandoned. The subject matter of that application is hereby incorporated by reference.

This invention relates to amorphous metallic alloys, commonly referred to metallic glasses, which are formed by solidification of alloy melts by cooling the alloy to a temperature below its glass transition temperature before appreciable nucleation and crystallization has occurred.

There has been appreciable interest in recent years in the formation of metallic alloys that are amorphous or glassy at low temperatures. Ordinary metals and alloys crystallize when cooled from the liquid phase. It has been found, however, that some metals and alloys can be undercooled and remain as an extremely viscous liquid phase or glass at ambient temperatures when cooled sufficiently rapidly. Cooling rates in the order of $10^4$ to $10^6$K/sec are typically required.

To achieve such rapid cooling rates, a very thin layer (e.g., less than 100 micrometers) or small droplets of molten metal are brought into contact with a conductive substrate maintained at near ambient temperature. The small dimension of the amorphous material is a consequence of the need to extract heat at a sufficient rate to suppress crystallization. Thus, most previously developed amorphous alloys have only been available as thin ribbons or sheets or as powders. Such ribbons, sheets or powders may be made by melt-spinning onto a cooled substrate, thin layer casting on a cooled substrate moving past a narrow nozzle, or as "splat quenching" of droplets between cooled substrates.

The resistance of a metallic glass to crystallization can be related to the cooling rate required to form the glass upon cooling from the melt. This is an indication of the stability of the amorphous phase upon heating above the glass transition temperature during processing. It is desirable that the cooling rate required to suppress crystallization be in the order of from 1K/s to $10^3$K/s or even less. As the critical cooling rate decreases, greater times are available for processing and larger cross sections of parts can be fabricated. Further, such alloys can be heated substantially above the glass transition temperature without crystallizing during time scales suitable for industrial processing.

Appreciable efforts have been directed to finding amorphous alloys with greater resistance to crystallization so that less restrictive cooling rates can be utilized. Recently, alloys of zirconium and/or titanium, copper and/or nickel, other transition metals and beryllium have been found which form amorphous bodies of substantial thickness. That is, the critical cooling rate is less than $10^3$K/s so that thick amorphous bodies can be cast.

Such alloy compositions are disclosed in U.S. Pat. Nos. 5,288,344 and 5,368,659. The subject matter of these prior patents is hereby incorporated by reference.

As has been mentioned, recently developed amorphous alloys contain beryllium which is a hazardous material. The alloys themselves are not hazardous since the beryllium content is actually very low. It would still be desirable, however, to provide amorphous alloys that have a low critical cooling rate and are substantially free of beryllium. This would alleviate precautions that should be taken during formation and processing of the alloys and also allay unwarranted concerns about using the beryllium containing alloys. Furthermore, beryllium is costly and providing amorphous alloys without beryllium would be desirable for this additional reason.

BRIEF SUMMARY OF THE INVENTION

Thus, there is provided in practice of this invention according to a presently preferred embodiment a class of at least quaternary alloys which form metallic glass upon cooling below the glass transition temperature at a rate less than $10^3$K/s. Two alloy compositions have been found to form amorphous solids with cooling rates that permit formation of objects with all dimensions being at least one millimeter. In other words, a sheet of such alloy has a thickness of at least one millimeter in its smallest dimension.

One such group of alloys comprises titanium in the range of from 19 to 41 atomic percent, an early transition metal (ETM) in the range of from 4 to 21 atomic percent and copper plus a late transition metal (LTM) in the range of from 49 to 64 atomic percent. The early transition metal comprises zirconium and/or hafnium. The late transition metal comprises cobalt and/or nickel. The composition is further constrained such that the product of the copper plus LTM times the atomic proportion of LTM relative to the copper is in the range of from 4 to 14. The atomic percentage of ETM is less than 10 when the atomic percentage of titanium is as high as 41, and may be as large as 21 when the atomic percentage of titanium is as low as 24. The atomic percentage of ETM is always less than a line connecting those values.

Stated somewhat more rigorously, the atomic percentage of early transition metal is less than 10 plus $(11/17)\cdot(41-a)$ where a is the atomic percentage of titanium present in the composition.

In addition, there are upper limits on the amount of LTM when the total of copper and LTM is low. Thus, when copper plus LTM is in the range of from 49 to 50 atomic percent, LTM is less than 8 atomic percent, when copper plus LTM is in the range of from 50 to 52 atomic percent, LTM is less than 9 atomic percent, when copper plus LTM is in the range of from 52 to 54 atomic percent, LTM is less than 10 atomic percent, when copper plus LTM is in the range of from 54 to 56 atomic percent, LTM is less than 12 atomic percent, and when copper plus LTM is greater than 56 atomic percent, LTM is less than 14 atomic percent.

This can be stated by the formula $$Ti_a(ETM)_b(Cu_{1-x}(LTM)_x)_c$$

where ETM is selected from the group consisting of Zr and Hf, LTM is selected from the group consisting of Ni and Co, x is atomic fraction, and a, b, and c are atomic percentages, wherein a is in the range of from 19 to 41, b is in the range of from 4 to 21, and c is in the range of from 49 to 64. There are the additional constraints that $2<x\cdot c<14$ and $b<10+(11/17)\cdot(41-a)$. Other constraints are that when $49<c<50$, then $x<8$; when $50<c<52$, then $x<9$; when $52<c<54$, then $x<10$; when $54<c<56$, then $x<12$; and when $c>56$, then $x<14$.

Another group of glass forming alloys has the formula $(ETM_{1-x}Ti_x)_aCu_b(Ni_{1-y}Co_y)_c$ where ETM is selected from the group consisting of Zr and Hf, x is atomic fraction, and a, b, and c are atomic percentages, wherein x is in the range of from 0.1 to 0.3, y•c is in the range of from 0 to 18, a is in the range of from 47 to 67, b is in the range of from 8 to 42, and c is in the range of from 4 to 37. This definition of the alloys has the additional constraints that (i) when a is in the range of from 60 to 67 and c is in the range of from 13 to 32, b is given by: $b \geqq 8+(12/7)\cdot(a-60)$; (ii) when a is in the range of from 60 to 67 and c is in the range of from 4 to 13, b is given by: $b \geqq 20+(19/10)\cdot(76-a)$; and (iii) when a is in the range of from 47 to 55 and c is in the range of from 11 to 37, b is given by: $b \geqq 8+(34/8)\cdot(55-a)$.

Either of these groups of alloys may also comprise up to about 4% other transition metals and a total of no more than 2% of other elements.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
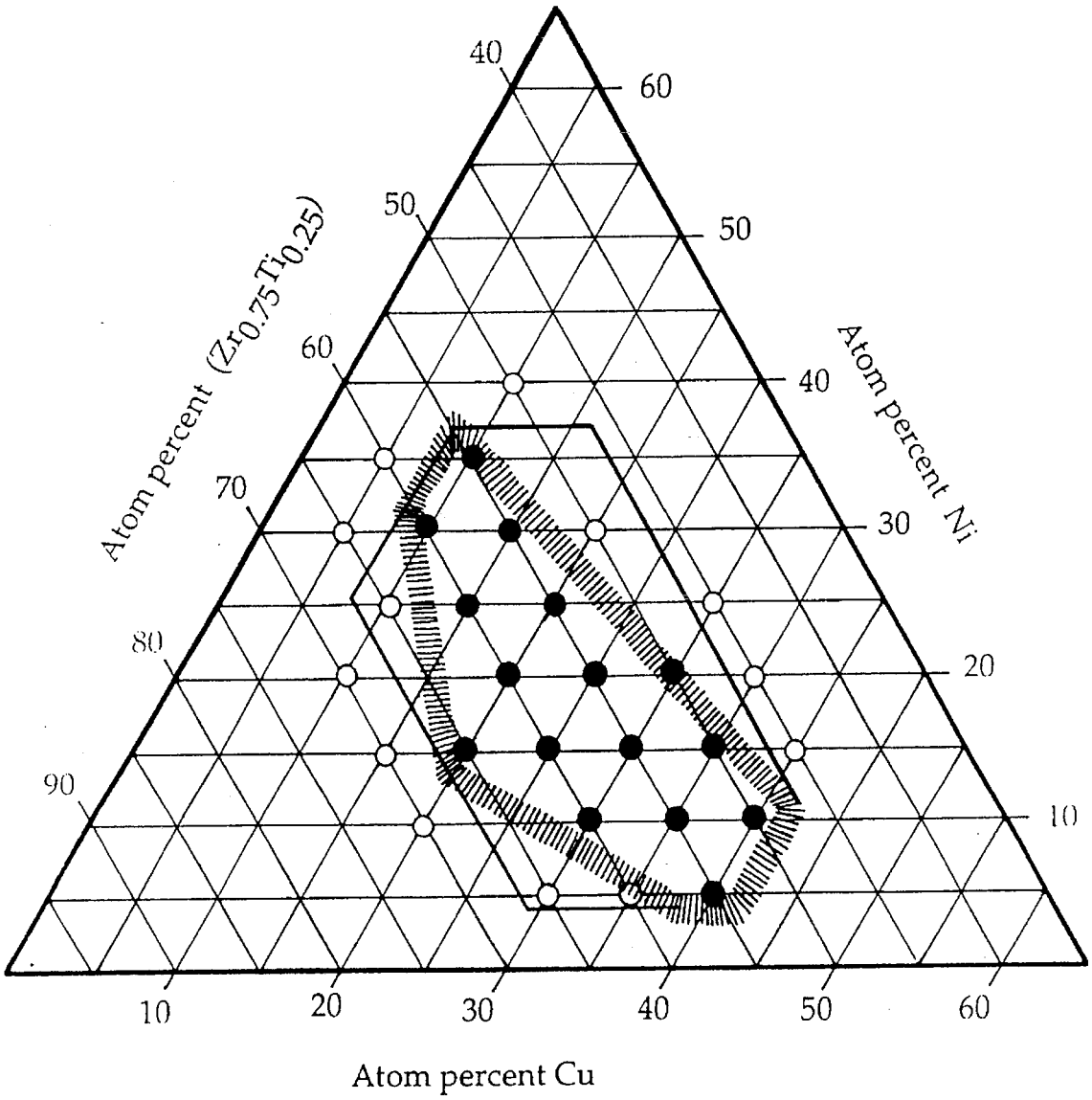
FIG. 1 is a quasi-ternary composition diagram indicating a glass forming region of alloys provided in practice of this invention.

For purposes of this invention, a metallic glass product is defined as a material which contains at least 50% by volume of the glassy or amorphous phase. Glass forming ability can be verified by splat quenching where cooling rates are in the order of $10^6$K /s. More frequently, materials provided in practice of this invention comprise substantially 100% amorphous phase. For alloys usable for making parts with dimensions larger than micrometers, cooling rates of less than $10^3$K/s are desirable. Preferably, cooling rates to avoid crystallization are in the range of from 1 to 100K/sec or lower. For identifying preferred glass forming alloys, the ability to cast layers at least one millimeter thick has been selected. Compositions where cast layers 0.5 mm thick are glassy are also acceptable. Generally speaking, an order of magnitude difference in thickness represents two orders of magnitude difference in cooling rate. A sample which is amorphous at a thickness of about one millimeter represents a cooling rate of about 500K/s. The alloys provided in practice of this invention are two orders of magnitude thicker than any previously known alloys which are substantially entirely transition metals.

Such cooling rates may be achieved by a broad variety of techniques, such as casting the alloys into cooled copper molds to produce plates, rods, strips or net shape parts of amorphous materials with thicknesses which may be more than one millimeter.

Conventional methods currently in use for casting glass alloys, such as splat quenching for thin foils, single or twin roller melt-spinning, water melt-spinning, or planar flow casting of sheets may also be used. Because of the slower cooling rates feasible, and the stability of the amorphous phase after cooling, other more economical techniques may be used for making net shape parts or large bodies that can be deformed to make net shape parts, such as bar or ingot casting, injection molding, powder metal compaction and the like.

A rapidly solidified powder form of amorphous alloy may be obtained by any atomization process which divides the liquid into droplets. Spray atomization and gas atomization are exemplary. Granular materials with a particle size of up to 1 mm containing at least 50% amorphous phase can be produced by bringing liquid drops into contact with a cold conductive substrate with high thermal conductivity, or introduction into an inert liquid. Fabrication of these materials is preferably done in inert atmosphere or vacuum due to high chemical reactivity of many of the materials.

A variety of new glass forming alloys have been identified in practice of this invention. The ranges of alloys suitable for forming glassy or amorphous material can be defined in various ways. Some of the composition ranges are formed into metallic glasses with relatively higher cooling rates, whereas preferred compositions form metallic glasses with appreciably lower cooling rates. Although the alloy composition ranges are defined by reference to quasi-ternary composition diagrams such as illustrated in the drawings, the boundaries of the alloy ranges may vary somewhat as different materials are introduced. The boundaries encompass alloys which form a metallic glass when cooled from the melting temperature to a temperature below the glass transition temperature at a rate substantially less than about $10^5$K/s, preferably less than $10^3$K/s and often at much lower rates, most preferably less than 100K/s.

Previous investigations have been of binary and ternary alloys which form metallic glass at very high cooling rates, generally more than $10^5$K/s. It has been discovered that quaternary, quinary or more complex alloys with copper, titanium, zirconium (or hafnium) and nickel (or in part cobalt) form metallic glasses with much lower critical cooling rates than previously thought possible. Ternary alloys of such materials will not make completely amorphous objects with a smallest dimension of at least one millimeter. Quaternary alloys with critical cooling rates as low as about 50K/s are found in practice of this invention.

Generally speaking, reasonable glass forming alloys are all at least quaternary alloys having titanium, copper, at least one early transition metal selected from the group consisting of zirconium and hafnium and at least one late transition metal selected from the group consisting of nickel and cobalt. A portion of iron, vanadium or zinc may be substituted instead of cobalt although the amount acceptable is believed to be lower. Zinc is less desirable because of its higher vapor pressure. Low critical cooling rates are found with at least quinary alloys having both cobalt and nickel and/or zirconium and hafnium. The glass forming alloys may also comprise up to 4% of other transition metals and a total of no more than 2% of other elements. (Unless indicated otherwise, composition percentages stated herein are atomic percentages.) The additional 2% may include beryllium, which tends to reduce the critical cooling rate.

The glass forming alloys fall into two groups. In one group, the titanium and copper are in a relatively lower proportion, zirconium is in a higher proportion and nickel is in a relatively broader range. In the other group, the titanium and copper are each in a relatively higher proportion, zirconium is in a low range and nickel is in a narrow range. In both groups hafnium is essentially interchangeable with zirconium. Within limits, cobalt can be substituted for nickel.

Broadly stated, the alloys include titanium in the range of from 5 to 41 atomic percent and copper in the range of from 8 to 61 percent. Nickel (and to some extent cobalt) may be in the range of from 2 to 37%. In one group the zirconium (and/or hafnium) is in the range of from 4 to 21% and in the other group it is in the range of from 30 to 57%. Within these broad ranges, there are alloys that do not have a sufficiently low cooling rate to form amorphous objects at least ½ or one millimeter thick as set forth in the various claims. Not all alloys within these ranges are claimed in this invention. The claims are only for an object having a smallest dimension of one millimeter which is at least 50% amorphous phase and having a composition within the recited ranges. If the object is not a metallic glass, it is not claimed.

When the object has a thickness of at least 1 mm in its smallest dimension, i.e., all dimensions of the object have a dimension of at least 1 mm., the cooling rate that can be achieved from the molten state through the glass transition temperature is no more than about $10^3$K/s. Higher cooling rates can be achieved only in much thinner sections. If the thickness of the glassy object is appreciably more than 1 mm, the cooling rate is, of course, commensurately lower. Compositions which have lower critical cooling rates and can form glassy alloys in such thicker sections are within the ranges disclosed. For example, alloys have been made completely amorphous in bodies having a smallest dimension of about two millimeters.

A number of examples of glass forming alloys are illustrated in the quasi-ternary composition diagrams of the drawings. FIG. 1 is a fraction of a quasi-ternary phase diagram where the lower left apex represents 100 atomic percent of a mixture of zirconium and titanium. In this particular diagram, the proportion is 75 percent zirconium and 25 percent titanium ($Zr_{0.75}Ti_{0.25}$). The lower right apex does not extend to 100% but represents 65 atomic percent copper and 35 percent of the mixture of titanium and zirconium. Similarly, the upper apex represents 65% nickel and 35 percent of the mixture of titanium and zirconium.

A number of alloy compositions within this region are illustrated. The compositions are characterized in two different ways. Compositions represented by open circles are glass forming alloys which form amorphous solids when the smallest dimension of the object, for example a sheet or ribbon, is less than about 1 mm. Closed circles represent alloys which form glass when the smallest dimension of the sample is approximately 1 mm. Some of the alloys represented by closed circles are glassy or amorphous with thicknesses as much as 2 mm or more.

Also sketched on FIG. 1 is a hexagonal boundary defining a region within which most of the alloy compositions disclosed can form amorphous alloys in sections at least 1 mm thick. It will be recognized that this is just a single slice in a complex quaternary system and, as pointed out with respect to formulas set forth hereinafter, the boundaries of the good glass forming region are subject to certain constraints which are not fully represented in this drawing.

Figure 2:
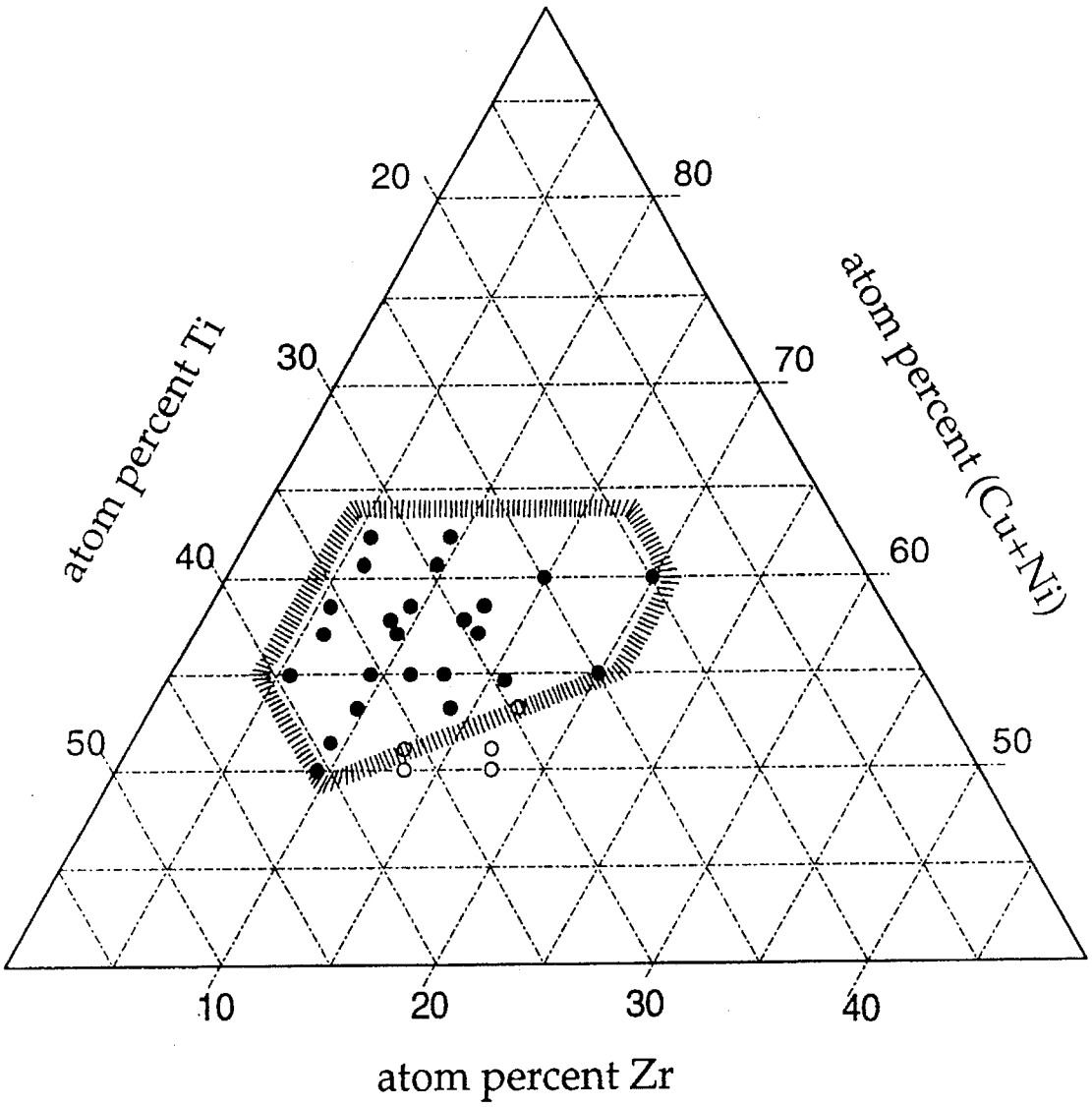
FIG. 2 is another quasi-ternary composition diagram indicating a related glass forming alloy region.

FIG. 2 is a portion of another quasi-ternary phase diagram where the lower left apex represents 60 atomic percent of titanium, 40 percent copper plus nickel and no zirconium. The scale on the opposite side of the triangle is the percentage of copper plus nickel. The upper apex of the diagram is at a composition of 10 percent titanium and 90 percent copper plus nickel. The lower right apex also does not extend to 100% but a composition with 50 percent zirconium, 10 percent titanium and 40 percent copper plus nickel.

A hexagonal boundary on FIG. 2 defines a region within which most of the alloy compositions disclosed can form amorphous alloys in sections at least 1 mm thick. Compositions represented by open circles are glass forming alloys which form amorphous solids when the smallest dimension of the object is less than about 1 mm. Closed circles represent alloys which form glass when the smallest dimension of the sample is approximately 1 mm.

The preferred alloy compositions within the glass forming region have a critical cooling rate for glass formation less than about $10^3$K/s and some appear to have critical cooling rates lower than 100K/s. The cooling rate is not well measured and may be, for example, $3\times10^3$ or below 10. A cooling rate of $10^3$ is considered to be the order of magnitude of samples about 0.5 to 1 mm thick.

For purposes of this specification an early transition metal (ETM) includes Groups 3, 4, 5, and 6 of the periodic table, including the lanthanide and actinide series. The previous IUPAC notation for these groups was IIIA, IVA, VA and VIA. For purposes of this specification, late transition metals (LTM) include Groups 7, 8, 9, 10 and 11 of the periodic table. The previous IUPAC notation was VIIA, VIIIA and IB.

The smaller hexagonal area illustrated in the FIG. 1 represents a glass forming region of alloys bounded by the composition ranges for alloys having a formula $$(ETM_{1-x}Ti_x)_aCu_b(Ni_{1-y}Co_y)_c$$

In this formula x and y are atomic fractions, and a, b, and c are atomic percentages. The early transition metal is selected from the group consisting of zirconium and hafnium. In this composition a is in the range of from 47 to 67, b is in the range of from 8 to 42, and c is in the range of from 4 to 37, subject to certain constraints. The atomic fraction of titanium, x, is in the range of from 0.1 to 0.3. The product of the atomic fraction of cobalt, y, and the atomic percentage, c, of the late transition metal (Ni plus Co), y•c, is in the range of from 0 to 18. In other words, there may be no cobalt present, and if there is, it is a maximum of 18 percent of the composition. In other words, nickel and cobalt are completely interchangeable up to 18 percent. If the total LTM is more than 18 atomic percent, up to 18 percent can be cobalt and any balance of late transition metal is nickel. This can be contrasted with the zirconium and hafnium which are apparently completely interchangeable.

The composition can also be defined approximately as comprising least four elements including titanium in the range of from 5 to 20 atomic percent, copper in the range of from 8 to 42 atomic percent, an early transition metal selected from the group consisting of zirconium and hafnium in the range of from 30 to 57 atomic percent and a late transition metal selected from the group consisting of nickel and cobalt in the range of from 4 to 37 atomic percent.

As mentioned, there are certain constraints on this formula definition of the good glass forming alloys. In other words, there are excluded areas within the region bounded by this formula. A first constraint is that when the ETM and titanium content, a, is in the range of from 60 to 67 and the LTM content, c, is in the range of from 13 to 32, the amount of copper, b, is given by the formula:

$$b \geqq 8+(12/7)\cdot(a-60).$$

Secondly, when a is in the range of from 60 to 67 and c is in the range of from 4 to 13, b is given by the formula:

$$b \geqq 20+(19/10)\cdot(67-a).$$

Finally, when a is in the range of from 47 to 55 and c is in the range of from 11 to 37, b is given by the formula:

$$b \geqq 8+(34/8)\cdot(55-a).$$

These constraints have been determined empirically. In the FIG. 1 there is a boundary illustrated by a solid line bounding a hexagonal region. This region illustrates the boundaries defined by the formula without the constraints on the value of b. A smaller hexagonal area is also illustrated with a "fuzzy" boundary represented by a shaded band. The constraints were determined by selecting points on the boundary represented by the solid lines and connecting the points by straight lines that included alloys that formed glassy alloys when cast with a section about one millimeter thick and excluded alloys that were not amorphous when cast about one millimeter thick. The constraints stated in the formulas above indicate the slopes of the lines so selected.

These selections are somewhat arbitrary. The data points in the composition diagram are at increments of five atomic percent. Thus, there is an uncertainty of the location of the boundary of about ±2%. The slopes indicated by the formulas are selected as a best approximation of the boundary. Alloys that apparently fall outside the boundaries so defined may be quite equivalent to compositions that are well within the boundaries insofar as the ability to form relatively thick glassy objects.

The smaller polygon formed by this formula and constraints in a quasi-ternary composition diagram of copper, nickel and a single apex for titanium plus zirconium ($Z_{0.75}Ti_{0.25}$) as illustrated by the shaded boundaries in FIG. 1 has as its six approximate corners:

| Corner # | a | b | c |
|---|---|---|---|
| 1 | 57 | 39 | 4 |
| 2 | 54 | 42 | 4 |
| 3 | 47 | 42 | 11 |
| 4 | 55 | 8 | 37 |
| 5 | 60 | 8 | 32 |
| 6 | 67 | 20 | 13 |

Preferably, the early transition metal is entirely zirconium since it is economical and provides the alloy with exceptional corrosion resistance and light weight. Preferably, the late transition metal is nickel since cobalt is somewhat more costly and lower critical cooling rates appear feasible with nickel than with cobalt.

Generally speaking, up to 4 atomic percent of other transition metals is acceptable in the glass alloy. It can also be noted that the glass alloy can tolerate appreciable amounts of what could be considered incidental or contaminant materials. For example, an appreciable amount of oxygen may dissolve in the metallic glass without significantly shifting the crystallization curve. Other incidental elements, such as germanium, phosphorus, carbon, nitrogen or oxygen may be present in total amounts less than about 2 atomic percent, and preferably in total amounts less than about one atomic percent.

The following is an expression of the formula for glass-forming compositions of differing scope. Such alloys can be formed into a metallic glass having at least 50% amorphous phase by cooling the alloy from above its melting point through the glass transition temperature at a sufficient rate to prevent formation of more than 50% crystalline phase. Objects with a smallest dimension of at least 1 mm can be formed with such alloys.

In the following formula of a good glass forming alloy, x is an atomic fraction and the subscripts a, b and c are atomic percentages:

$$Ti_a(ETM)_b(Cu_{1-x}(LTM)_x)_c$$

The early transition metal, ETM, is selected from the group consisting of zirconium and hafnium. The late transition metal, LTM, is selected from the group consisting of nickel and cobalt. In this alloy range, the titanium content, a, is in the range of from 19 to 41, the proportion of early transition metal, b is in the range of from 4 to 21, and the amount of copper plus other late transition metal, c is in the range of from 49 to 64. Again, there are certain constraints on the region bounded by this formula. The product, x•c, of the LTM content, x, and the total of copper plus LTM, c, is between 2 and 14. That is, $2<x\cdot c<14$. Furthermore, the amount of ETM is limited by the titanium content of the alloy so that $b<10+(11/17)\cdot(41-a)$.

It has been found that there are additional constraints on the boundary of good glass forming alloys. When the total of copper plus nickel or cobalt is at the low end of the range, the proportion of LTM cannot be too high or crystallization is promoted and good glass forming is not obtained. Thus, when copper plus LTM is in the range of from 49 to 50 atomic percent, LTM is less than 8 atomic percent, when copper plus LTM is in the range of from 50 to 52 atomic percent, LTM is less than 9 atomic percent, when copper plus LTM is in the range of from 52 to 54 atomic percent, LTM is less than 10 atomic percent, when copper plus LTM is in the range of from 54 to 56 atomic percent, LTM is less than 12 atomic percent, and when copper plus LTM is greater than 56 atomic percent, LTM is less than 14 atomic percent.

Stated differently by formula, the constraints are when $49<c<50$, then $x<8$; when $50<c<52$, then $x<9$; when $52<c<54$, then $x<10$; when $54<c<56$, then $x<12$; and when $c>56$, then $x<14$.

The polygon formed with this formula and the constraints on the triangular composition diagram of titanium, zirconium and a third apex representing combined copper plus nickel as illustrated in FIG. 2 has as its six approximate corners:

| Corner # | a | b | c |
|---|---|---|---|
| 1 | 41 | 10 | 49 |
| 2 | 24 | 21 | 55 |
| 3 | 19 | 21 | 60 |
| 4 | 19 | 17 | 64 |
| 5 | 32 | 4 | 64 |
| 6 | 41 | 4 | 55 |

With the variety of material combinations encompassed by the ranges described, there may be unusual mixtures of metals that do not form at least 50% glassy phase at cooling rates less than about $10^5$K/s. Suitable combinations may be readily identified by the simple expedient of melting the alloy composition, splat quenching and verifying the amorphous nature of the sample. Preferred compositions are readily identified with lower critical cooling rates.

The amorphous nature of the metallic glasses can be verified by a number of well known methods. X-ray diffraction patterns of completely amorphous samples show broad diffuse scattering maxima. When crystallized material is present together with the glass phase, one observes relatively sharper Bragg diffraction peaks of the crystalline material.

The fraction of amorphous phase present can also be estimated by differential thermal analysis. One compares the enthalpy released upon heating the sample to induce crystallization of the amorphous phase to the enthalpy released when a completely glassy sample crystallizes. The ratio of these heats gives the molar fraction of glassy material in the original sample. Transmission electron microscopy analysis can also be used to determine the fraction of glassy material. Transmission electron diffraction can be used to confirm the phase identification. The volume fraction of amorphous material in a sample can be estimated by analysis of the transmission electron microscopy images.

EXAMPLES

Following is a table of alloys which can be cast in a strip at least one millimeter thick with more than 50% by volume amorphous phase. The alloys listed fall within the boundaries of an region defined by the formula $$Ti_a(ETM)_b(Cu_{1-x}(LTM)_x)_c$$

where ETM is selected from the group consisting of Zr and Hf and LTM is selected from the group consisting of Ni and Co where a is in the range of from 19 to 41, b is in the range of from 4 to 21, and c is in the range of from 49 to 64. Furthermore, the boundaries are constrained such that $2<x \cdot c<14$ and $b<10+(11/17) \cdot (41-a)$.

TABLE I

| Atomic Percentages | | | | Minimum Thickness |
|---|---|---|---|---|
| Ti | Zr | Cu | Ni | (mm) |
| 33.0 | 13.4 | 49.6 | 4 | 1 |
| 36.9 | 9.6 | 49.5 | 4 | 2 |
| 33.0 | 9.6 | 53.4 | 4 | 2 |
| 29.2 | 13.4 | 53.4 | 4 | 2 |
| 40.7 | 9.6 | 45.7 | 4 | 1 |
| 36.9 | 5.7 | 53.4 | 4 | 1 |
| 33 | 5.8 | 57.2 | 4 | 1 |
| 29.2 | 9.6 | 57.2 | 4 | 2 |
| 32.2 | 12.9 | 46.9 | 8 | 2 |
| 35.9 | 9.4 | 46.9 | 8 | 2 |
| 32.2 | 9.2 | 50.6 | 8 | 2 |
| 28.5 | 12.9 | 50.6 | 8 | 2 |
| 39.6 | 9.2 | 43.2 | 8 | 1 |
| 39.6 | 5.5 | 46.9 | 8 | 1 |
| 35.9 | 5.5 | 50.6 | 8 | 1 |
| 32.2 | 5.5 | 54.3 | 8 | 1 |
| 28.5 | 9.2 | 54.3 | 8 | 1 |
| 34 | 11 | 47 | 8 | 3 |
| 25 | 20 | 45 | 10 | 1 |
| 25 | 15 | 50 | 10 | 1 |
| 20 | 20 | 50 | 10 | 1 |
| 33.8 | 11.3 | 45 | 10 | 4 |
| 29.9 | 15.4 | 42.7 | 12 | 1 |
| 29.9 | 11.9 | 46.2 | 12 | 1 |
| 33.4 | 8.4 | 46.2 | 12 | 1 |

It will be noted that at least one of the alloy compositions can be cast into an object with a minimum thickness of at least three or four millimeters, such a composition has about 34 percent titanium, about 11 percent zirconium and about 55 total percentage of copper and nickel, either 45 or 47 percent copper and 8 or 10 percent nickel. Another good glass forming alloy has a formula $Cu_{52}Ni_8Zr_{10}Ti_{30}$. It can be cast in objects having a smallest dimension of at least 3 mm.

Following is a table of alloys which can be cast in a strip at least one millimeter thick with more than 50% by volume amorphous phase. The alloys listed fall within the boundaries of an region defined by the formula $$(Zr_{1-x}Ti_x)_aCu_b(Ni_{1-y}Co_y)_c$$

wherein x is in the range of from 0.1 to 0.3, a is in the range of from 47 to 67, b is in the range of from 8 to 42, and c is in the range of from 4 to 37. In these examples y is zero. In addition there are the following constraints: (i) When a is in the range of from 60 to 67 and c is in the range of from 13 to 32, b is given by: $b \geqq 8+(12/7) \cdot (a-60)$; (ii) when a is in the range of from 60 to 67 and c is in the range of from 4 to 13, b is given by: $b \geqq 20+(19/10) \cdot (76-a)$; and (iii) when a is in the range of from 47 to 55 and c is in the range of from 11 to 37, b is given by: $b \leqq 8+(34/8) \cdot (55-a)$.

TABLE II

| Zr | Ti | Cu | Ni |
|---|---|---|---|
| 41.2 | 13.8 | 10 | 35 |
| 41.2 | 13.8 | 15 | 30 |
| 45 | 15 | 10 | 30 |
| 45 | 15 | 15 | 25 |
| 41.2 | 13.8 | 20 | 25 |
| 41.2 | 13.8 | 25 | 20 |
| 45 | 15 | 20 | 20 |
| 37.5 | 12.5 | 30 | 20 |
| 45 | 15 | 25 | 15 |
| 48.8 | 16.2 | 20 | 15 |
| 41.2 | 13.8 | 30 | 15 |
| 37.5 | 12.5 | 35 | 15 |
| 37.5 | 12.5 | 40 | 10 |
| 41.2 | 13.8 | 35 | 10 |
| 45 | 15 | 30 | 10 |
| 41.2 | 13.8 | 40 | 5 |

A number of categories and specific examples of glass-forming alloy compositions having low critical cooling rates are described herein. It will apparent to those skilled in the art that the boundaries of the glass-forming regions described are approximate and that compositions somewhat outside these precise boundaries may be good glass-forming materials and compositions slightly inside these boundaries may not be glass-forming materials at cooling rates less than 1000K/s. Thus, within the scope of the following claims, this invention may be practiced with some variation from the precise compositions described.

What is claimed is:

1. A metallic glass object having a thickness of at least one millimeter in its smallest dimension formed of an alloy comprising at least four elements including:

titanium in the range of from 5 to 20 atomic percent;

copper in the range of from 8 to 42 atomic percent;

an early transition metal selected from the group consisting of zirconium and hafnium in the range of from 30 to 57 atomic percent;

a late transition metal selected from the group consisting of nickel and cobalt in the range of from 4 to 37 atomic percent;

up to 4 atomic percent of other transition metals; and a total of no more than 2 atomic percent of other elements.

2. A metallic glass object as recited in claim 1 wherein the early transition metal is only Zr and the late transition metal is only nickel.

3. A metallic glass object as recited in claim 1 wherein titanium is in the range of from 9.4 to 20 atomic percent.

4. A metallic glass object having a thickness of at least 0.5 mm in its smallest dimension formed of an alloy having the formula $$Ti_a(ETM)_b(Cu_{1-x}(LTM)_x)_x$$

where ETM is selected from the group consisting of Zr and Hf, LTM is selected from the group consisting of Ni and Co, x is atomic fraction, and a, b, and c are atomic percentages, wherein a is in the range of from 19 to 41, b is in the range of from 4 to 21, and c is in the range of from 49 to 64 under the constraints of $2<x \cdot c<14$ and $b<10+(11/17) \cdot (41-a)$; and under the constraints:

when $49<c<50$, then $x \cdot c<8$;

when $50<c<52$, then $x \cdot c<9$;

when $52<c<54$, then $x \cdot c<10$;

when $54<c<56$, then $x \cdot c<12$; and when $c>56$, then $x \cdot c<14$.

5. A metallic glass object as recited in claim 4 wherein ETM is only Zr and LTM is only Ni.

6. A metallic glass object as recited in claim 4 wherein the alloy further comprises up to 4% other transition metals and a total of no more than 2% of other elements.

7. A metallic glass object as recited in claim 4 wherein $x \cdot c$ is in the range of from 7 to 11.

8. A metallic glass object as recited in claim 4 wherein the thickness of the object is at least one millimeter in its smallest dimension.

9. A metallic glass object having a thickness of at least 0.5 mm in its smallest dimension formed of an alloy having the formula $$(ETM_{1-x}Ti_x)_a Cu_b (Ni_{1-y}Co_y)_c$$

where ETM is selected from the group consisting of Zr and Hf, x and y are atomic fractions, and a, b, and c are atomic percentages, wherein x is in the range of from 0.1 to 0.3, $y \cdot c$ is in the range of from 0 to 18, a is in the range of from 47 to 67, b is in the range of from 8 to 42, and c is in the range of from 4 to 37 under the following constraints:

(i) when a is in the range of from 60 to 67 and c is in the range of from 13 to 32, b is given by: $b \geqq 8+(12/7) \cdot (a-60)$;

(ii) when a is in the range of from 60 to 67 and c is in the range of from 4 to 13, b is given by: $b \geqq 20+(19/10) \cdot (76-a)$; and (iii) when a is in the range of from 47 to 55 and c is in the range of from 11 to 37, b is given by: $b \leqq 8+(34/8) \cdot (55-a)$.

10. A metallic glass object as recited in claim 9 wherein ETM is only Zr and y is zero.

11. A metallic glass object as recited in claim 9 wherein x is in the range of from 0.2 to 0.3.

12. A metallic glass object as recited in claim 9 wherein the alloy further comprises up to 4% other transition metals and a total of no more than 2% of other elements.

13. A metallic glass object as recited in claim 9 wherein the thickness of the object is at least one millimeter in its smallest dimension.

14. A method for making a metallic glass having at least 50% amorphous phase with the thickness of the glass being at least 0.5 mm in its smallest dimension comprising the steps of:

formulating an alloy having the formula $$Ti_a (ETM)_b (Cu_{1-x}(LTM)_x)_c$$

where ETM is selected from the group consisting of Zr and Hf, LTM is selected from the group consisting of Ni and Co, x is atomic fraction, and a, b, and c are atomic percentages, wherein a is in the range of from 19 to 41, b is in the range of from 4 to 21, and c is in the range of from 49 to 64 under the constraints of $2<x \cdot c<14$ and $b<10+(11/17) \cdot (41-a)$; and under the constraints:

when $49<c<50$, then $x \cdot c<8$;

when $50<c<52$, then $x \cdot c<9$;

when $52<c<54$, then $x \cdot c<10$;

when $54<c<56$, then $x \cdot c<12$;

when $c>56$, then $x \cdot c<14$; and cooling the alloy sufficiently rapidly for remaining as a metallic glass at least 0.5 mm thick.

15. A method as recited in claim 14 wherein ETM is only Zr and LTM is only Ni.

16. A method as recited in claim 14 wherein the alloy further comprises up to 4% other transition metals and a total of no more than 2% of other elements.

17. A method as recited in claim 14 wherein $x \cdot c$ is in the range of from 7 to 11.

18. A method for making a metallic glass having at least 50% amorphous phase with a thickness of at least 0.5 mm in its smallest dimension comprising the steps of:

formulating an alloy having the formula $$(ETM_{1-x}Ti_x)_a Cu_b (Ni_{1-y}Co_y)_c$$

where ETM is selected from the group consisting of Zr and Hf, x and y are atomic fractions, and a, b, and c are atomic percentages, wherein x is in the range of from 0.1 to 0.3, $y \cdot c$ is in the range of from 0 to 18, a is in the range of from 47 to 67, b is in the range of from 8 to 42, and c is in the range of from 4 to 37 under the following constraints:

(i) when a is in the range of from 60 to 67 and c is in the range of from 13 to 32, b is given by: $b \leqq 9+(12/7) \cdot (a-60)$;

(ii) when a is in the range of from 60 to 67 and c is in the range of from 4 to 13, b is given by: $b \leqq 20+(19/10) \cdot (67-a)$; and (iii) when a is in the range of from 47 to 55 and c is in the range of from 11 to 37, b is given by: $b \geqq 8+(34/8) \cdot (55-a)$; and cooling the alloy sufficiently rapidly for remaining as a metallic glass at least 0.5 mm thick.

19. A method as recited in claim 18 wherein ETM is only Zr and y is zero.

20. A method as recited in claim 18 wherein x is in the range of from 0.2 to 0.3.

21. A method as recited in claim 18 wherein the alloy further comprises up to 4% other transition metals and a total of no more than 2% of other elements.

22. A method for making a metallic glass having at least 50% amorphous phase with a thickness of at least one millimeter in its smallest dimension comprising the steps of:

formulating an alloy having at least four elements including:

titanium in the range of from 5 to 20 atomic percent, copper in the range of from 8 to 42 atomic percent, an early transition metal selected from the group consisting of zirconium and hafnium in the range of from 30 to 57 atomic percent;

a late transition metal selected from the group consisting of nickel and cobalt in the range of from 4 to 37 atomic percent; and cooling the alloy sufficiently rapidly for remaining as a metallic glass at least 0.5 mm thick.

23. A metallic glass having an as cast thickness of at least one millimeter in its smallest dimension formed of an alloy comprising at least four elements including:

about 34 atomic percent titanium;

about 47 atomic percent copper;

about 11 atomic percent zirconium; and about 8 atomic percent nickel.

24. A metallic glass having an as cast thickness of at least one millimeter in its smallest dimension formed of an alloy comprising at least four elements including:

about 33.8 atomic percent titanium;

about 45 atomic percent copper;

about 11.3 atomic percent zirconium; and about 10 atomic percent nickel.

* * * * *

UNITED STATES PATENT AND TRADEMARK OFFICE

CERTIFICATE OF CORRECTION

PATENT NO. : 5,618,359

DATED : April 8, 1997

INVENTOR(S) : Xianghong Lin; Atakan Peker; William L. Johnson

It is certified that error appears in the above-indentified patent and that said Letters Patent is hereby corrected as shown below:

Column 1, line 15, before "metallic" insert -- as --.
Column 3, line 13, the equation should read -- $b \geqq 20+(19/10)\cdot(67-a)$ --.
Column 6, line 10, change "below 10." to -- below $10^3$. --.
Column 6, line 21, before "FIG. 1" delete "the".
Column 6, line 46, after "comprising" insert -- at --.
Column 7, line 7, before "FIG. 1" delete "the".
Column 7, line 30, change "$(Z_{0.75}Ti_{0.25})$" to -- $(Zr_{0.75}Ti_{0.25})$ --.
Column 9, lines 18,67, change "an region" to -- a region --.
Column 10, line 10, the equation should read -- $b \geqq 20+(19/10)\cdot(67-a)$ --.
Column 10, line 33, after "will" insert -- be --.
Column 10, line 67, the formula should read -- $Ti_a(ETM)_b(Cu_{1-x}(LTM_x)_c$ --
Column 11, lines 47,48, the equation should read -- $b \geqq 20+(19/10)\cdot(67-a)$ --.
Column 12, line 46, the equation should read -- $b \geq 8 + (12/7)\bullet(a - 60)$
Column 12, line 48, the equation should read -- $b \geqq 20+(19/10)\cdot(67-a)$ --.
Column 12, line 52, the equation should read -- $b \leqq 8+(34/8)\cdot(55-a)$ --.

Signed and Sealed this

Second Day of June, 1998

*Attest:*

*Attesting Officer*

BRUCE LEHMAN

*Commissioner of Patents and Trademarks*